US008404989B2

(12) United States Patent
Han

(10) Patent No.: US 8,404,989 B2
(45) Date of Patent: Mar. 26, 2013

(54) MEMBRANE SWITCH SHEET

(75) Inventor: Sang Hyun Han, Anyang-si (KR)

(73) Assignee: Pointchips Co., Ltd., Seoul (KR)

( * ) Notice: Subject to any disclaimer, the term of this patent is extended or adjusted under 35 U.S.C. 154(b) by 284 days.

(21) Appl. No.: 12/993,387

(22) PCT Filed: May 18, 2009

(86) PCT No.: PCT/KR2009/002610

§ 371 (c)(1),
(2), (4) Date: Nov. 18, 2010

(87) PCT Pub. No.: WO2009/142417

PCT Pub. Date: Nov. 26, 2009

(65) Prior Publication Data

US 2011/0073458 A1 Mar. 31, 2011

(30) Foreign Application Priority Data

May 20, 2008 (KR) ..... 10-2008-0046535

(51) Int. Cl.
*H01H 1/10* (2006.01)

(52) U.S. Cl. ..... 200/512; 200/5 A

(58) Field of Classification Search ..... 200/5 A, 200/511–517; 341/22, 34; 345/168, 169
See application file for complete search history.

(56) References Cited

U.S. PATENT DOCUMENTS

| | | | | |
|---|---|---|---|---|
| 4,440,990 | A | 4/1984 | Nozaki | |
| 4,623,768 | A * | 11/1986 | Gnant | 200/512 |
| 4,701,579 | A * | 10/1987 | Kurachi et al. | 200/5 A |
| 4,994,634 | A * | 2/1991 | Tanji et al. | 200/5 A |
| 5,514,842 | A * | 5/1996 | Sugii et al. | 200/5 A |
| 5,892,191 | A * | 4/1999 | Hagiya et al. | 200/5 A |
| 7,391,342 | B1 * | 6/2008 | Mui | 341/22 |
| 2008/0230362 | A1 * | 9/2008 | Hsu | 200/512 |
| 2010/0066567 | A1 * | 3/2010 | Dietz et al. | 341/22 |

FOREIGN PATENT DOCUMENTS

| | | |
|---|---|---|
| JP | 06-275170 | 9/1994 |
| JP | 06-332598 | 12/1994 |
| JP | 09-139151 | 5/1997 |
| KR | 10-1992-0007747 | 9/1992 |

* cited by examiner

*Primary Examiner* — Michael Friedhofer
(74) *Attorney, Agent, or Firm* — Sherr & Jiang, PLLC

(57) ABSTRACT

Disclosed herein is a membrane switch sheet for a switch matrix-type key input apparatus. The membrane switch sheet is used in a switch matrix-type key input apparatus, including a plurality of switch contacts, so as to prevent the occurrence of a ghost key phenomenon. The membrane switch sheet includes at least one film wired through a single patterning process using only ink having low conductivity so as to have resistors having a same resistance value, with distances between start points of lines of a switch matrix in a column scan direction and the switch contacts being set to the same value.

3 Claims, 8 Drawing Sheets

*-Prior Art-*

*-Prior Art-*

*-Prior Art-*

*-Prior Art-*

MEMBRANE SWITCH SHEET

CROSS REFERENCE TO PRIOR APPLICATIONS

This application is a National Stage Patent Application of International Patent Application No. PCT/KR2009/002610 (filed on May 18, 2009) under 35 U.S.C. §371, which claims priority to Korean Patent Application No. 10-2008-0046535 (filed on May 20, 2008), which are all hereby incorporated by reference in their entirety.

TECHNICAL FIELD

The present invention relates to a membrane switch sheet for a switch matrix-type key input apparatus.

BACKGROUND ART

Generally, a membrane switch sheet provides a switch matrix structure which is widely used in key input apparatuses such as membrane-type keyboards.

A membrane-type keyboard is a keyboard in which a thin conductive film is placed under keys. In a membrane method, ON or OFF is determined based on the contact between sheets using the elastic force of the membrane.

Silicon rubber has been known to be placed under the keys of a keyboard which uses such a membrane switch.

When a key placed on top of the silicon rubber is pressed, a specific portion of the silicon rubber exerts pressure against the top of a contact (switch) of the membrane switch sheet.

At this time, the contacts (switches) of the upper and lower films of the membrane switch sheet form a connection. Accordingly, an operation of pressing the key is transmitted using an electrical signal conducted through the contacts.

When the key is no longer being pressed, the contacts (switches) of the upper and lower films of the membrane switch sheet become separated from each other by the elastic (restoring) force of the membrane switch sheet and the elastic (restoring) force of the silicon rubber. Accordingly, since an electrical signal is no longer being conducted through the contacts, it is recognized that the operation of pressing the key has stopped.

The membrane switch sheet includes three thin polyester films. An example of the membrane switch sheet will be described below with reference to FIGS. 1 to 4.

FIG. 1 is a diagram illustrating a conventional membrane switch sheet 71.

Referring to FIG. 1, the membrane switch sheet 71 includes a thin film-type insulating spacer material 72 provided with a plurality of through holes 75 and a pair of flexible thin insulation films 73 and 74 stacked on and beneath the insulating spacer material 72, respectively.

The insulating spacer material 72 and the thin insulation films 73 and 74 may be formed of, for example, polyester films.

One thin insulation film 73 includes second electrodes 76, resistors 77 and lines 78, which are formed on the surface thereof which comes into contact with the spacer material 72, using a pattern formation method. The second electrodes 76 are placed opposite the respective through holes 72. The lines 78 are connected to the lead portions of the second electrodes 76, the lead portions of the resistors 77 and the other ends of the resistors 77.

The lines 80 of the other thin insulation film 74 include lines 80*a* configured to connect first electrodes 79 in series and lines 80*b* configured to connect the first electrodes 79 to an external element.

The electrodes 76 and 79 and the lines 78 and 80 may have a two-layer structure including a first conductive layer made of silver and a layer configure to have a low resistance value, or a two-layer structure including a second layer formed on a first layer having a low resistance value in order to prevent movement.

The switch pattern having the first layer and the second layer may be formed by mixing an ink base, such as polyester or epoxy, with silver powder or conductive carbon, printing a mixture on the film, and then performing heating and sintering. The printed surface operates as an electric conductor having a resistant property that enables electrical signals to be transmitted.

The signal lines formed on the films through the printing process using the conductive ink can achieve a desired conductivity (a proper resistance value) by adjusting the mixing ratio of a conductive medium, such as silver powder or conductive carbon, to the ink base.

In FIG. 1, the membrane switch sheet 71 includes the thin insulation film 74 separated from the thin insulation film 73 and the spacer material 72. In the membrane switch sheet 71, when the top surface of the thin insulation film 74 on which an electrode 79 is formed is pressed downward by a key, the corresponding electrode 79 is connected to the opposite electrode 76 on the thin insulation film 73 by the deformation of the thin insulation film 74. When the downward force is released, the contact between the electrodes 76 and 79 is removed by the elastic force of the thin insulation film 74.

FIGS. 2 to 4 are diagrams illustrating another conventional membrane switch sheet.

FIG. 2 shows the lower film of the membrane switch sheet, FIG. 3 shows the center film of the membrane switch sheet, and FIG. 4 shows the upper film of the membrane switch sheet. The three films are stacked one on top of another, thus forming the membrane switch sheet. The membrane switch sheet constitutes the upper portion of a switch matrix in order to form a switch matrix-type key input apparatus.

The lower film 23 of the membrane switch sheet shown in FIG. 2 is formed by printing the lines of the switch matrix in the column scan direction on the top surface of the film 23 using conductive ink. Here, patterning is performed twice because two types of resistors Rs and Rr have to be patterned. The resistors Rr having a high resistance value and the resistors Rs having a low resistance value have to be separately patterned. Furthermore, the center film 24 of the membrane switch sheet shown in FIG. 3 includes a plurality of holes which will become switches. The center file 2 functions as an insulator with only portions for switches removed therefrom. Finally, the upper film 25 of the membrane switch sheet shown in FIG. 4 is formed by printing the lines of the switch matrix in the row scan direction on a film using conductive ink having a resistance value Rs.

In the membrane switch sheet composed of three sheets of film, that is, the lower film 23, the center film 24 and the upper film 25, when weight is applied to the upper film (i.e., when a key signal is input through the switching operation of the switch matrix, a contact is formed between the upper film 25 and the lower film 23, thus turning on a switch. When the weight is released (i.e., when the switching operation of the switch matrix is stopped), the switch is turned off by the restoring force of the film itself.

The switch pattern having the lower film 23 and upper film 25 of the membrane switch sheet is formed by mixing silver powder or conductive carbon with an ink base such as polyester or epoxy, printing a mixture on the film and then performing heating and sintering. The printed surface functions as an electric conductor having a resistant property that enables electrical signals to be transmitted. As described above, the resistors Rs are formed on the upper film 25 through the printing process using the conductive ink, so that the resistors having conductivity can be used as contacts. Furthermore, the resistors Rs having a low resistance value and the resistors Rr having a high resistance value are also formed on the lower film 23 using conductive ink through a first printing process and a second printing process, respectively, so that the resistors having conductivity are used as the contacts.

Accordingly, the signal lines formed on the upper film 25 and the lower film 23 through the printing processes using the conductive ink can achieve a desired conductivity (a proper resistance value) by adjusting the mixing ratio of the conductive medium, such as silver powder or conductive carbon, to the ink base.

As described above, the conventional membrane switch sheet is implemented by forming the patterns, corresponding to switch wiring having a low resistance value, such as the resistors Rs, in the lines of the column scan direction and then forming the resistors Rr having a high resistance value near the contacts of the switches.

However, the conventional membrane switch sheet is problematic in that the manufacturing process is complicated and the manufacturing price is high because it requires conductive ink (the resistors Rr and Rs) to be printed on the lower film 23 (i.e., the same polyester film) in two separate processes and requires heating and sintering to be performed.

DISCLOSURE

Technical Problem

Accordingly, the present invention has been made keeping in mind the above problems occurring in the prior art, and an object of the present invention is to provide a membrane switch sheet which is capable of reducing the number of processes of manufacturing a membrane switch sheet and the manufacturing cost.

Technical Solution

In order to accomplish the above object, the present invention provides a membrane switch sheet used in a switch matrix-type key input apparatus, including a plurality of switch contacts, so as to prevent occurrence of a ghost key phenomenon, the membrane switch sheet including at least one film wired through a single patterning process using only ink having low conductivity so as to have resistors having a same resistance value, with distances between start points of lines of a switch matrix in a column scan direction and the switch contacts being set to the same value.

Furthermore, the electric conductor of the ink having low conductivity may be any one of silver powder, carbon powder and another conductive material.

Furthermore, the resistors having the same resistance value may be patterned on the film through a single printing process, with a portion of the electric conductor and a resistance value per square being adjusted.

Advantageous Effects

The present invention has the advantages of reducing the manufacturing time and the manufacturing cost by simplifying a process of printing conductive ink on a lower film in a process of manufacturing a membrane switch sheet.

DESCRIPTION OF DRAWINGS

The above and other objects, features and advantages of the present invention will be more clearly understood from the following detailed description taken in conjunction with the accompanying drawings, in which.

Figure 1:
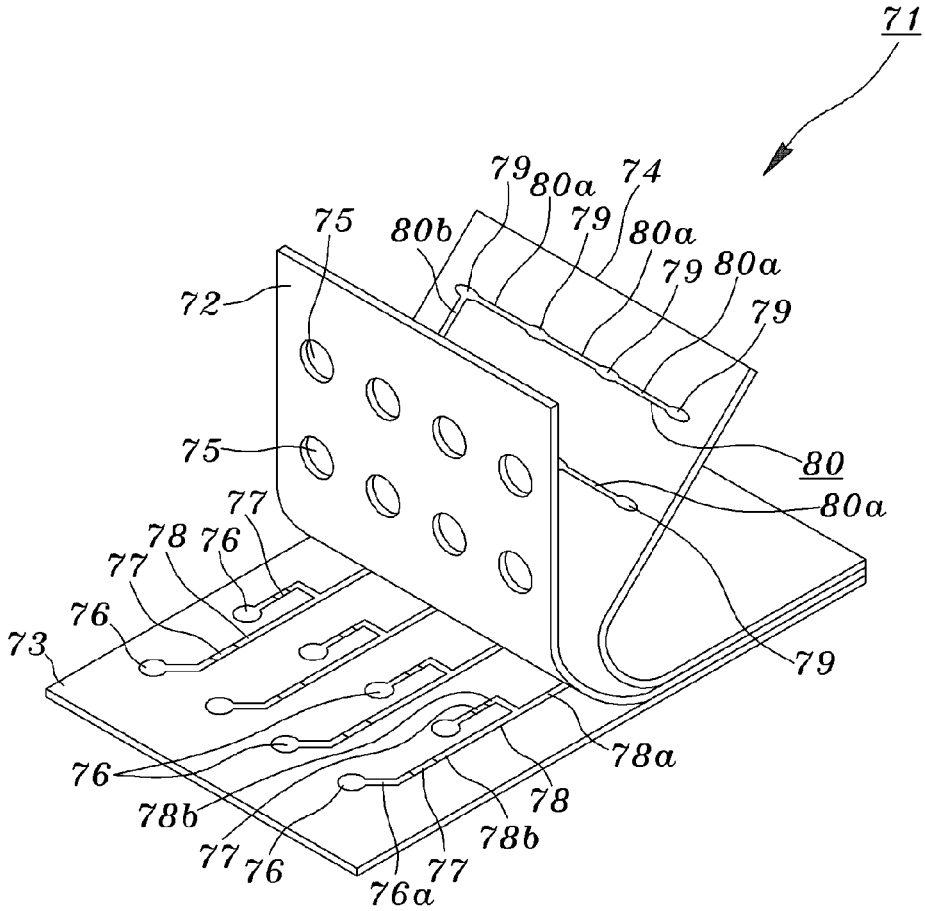
FIG. 1 is a diagram illustrating a conventional membrane switch sheet.
Figure 2:
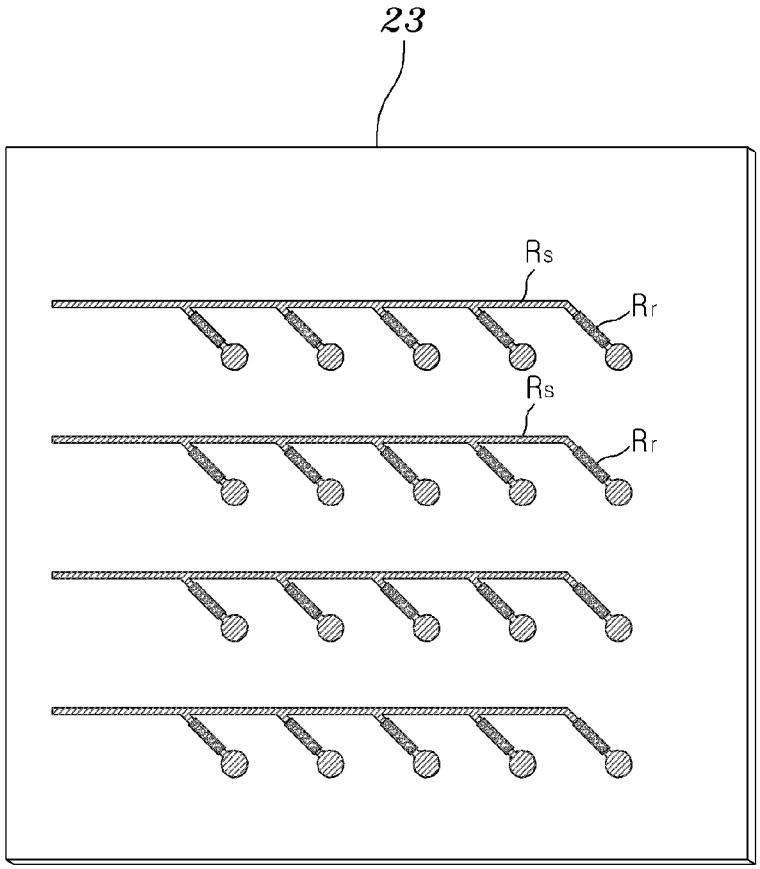
FIGS. 2 to 4 are diagrams illustrating another conventional membrane switch sheet.
Figure 3:
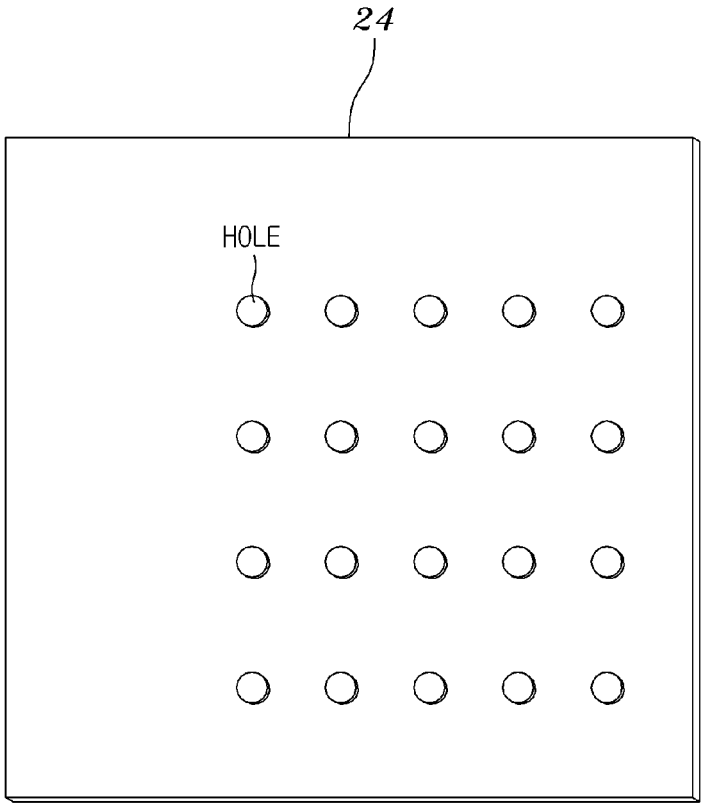
Figure 4:
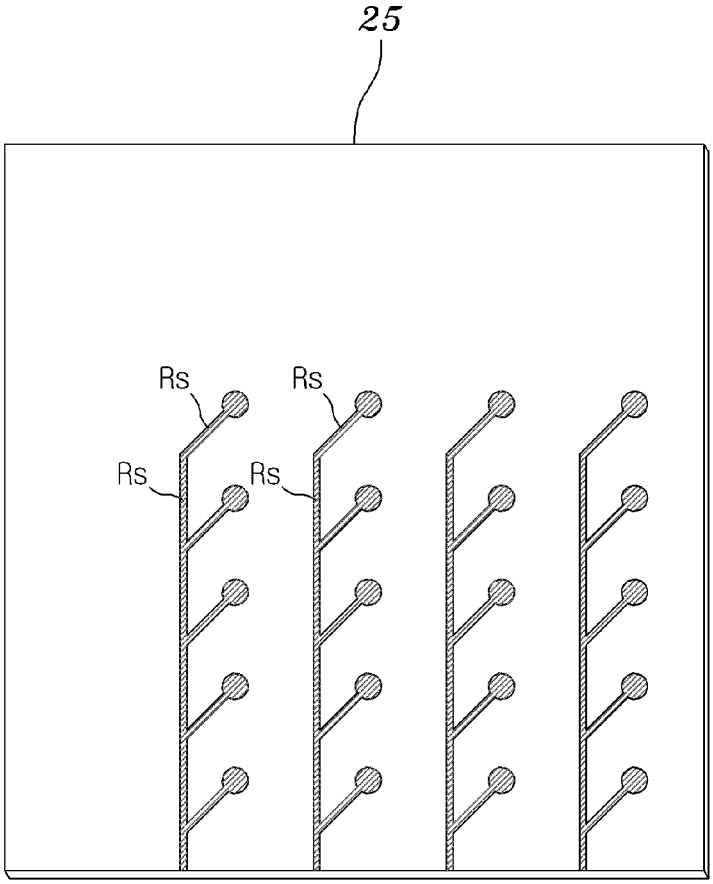

Description of Reference Numerals of Principal Elements in the Drawings

| | |
|---|---|
| 26: lower film | 27: center film |
| 28: upper film | |

MODE FOR INVENTION

With regard to the membrane switch sheet of the present invention, when resistors are formed by patterning conductive ink on a lower film, resistors are formed by patterning resistors Rrr each having an intermediate value instead of patterning first resistors Rr each having a high resistance value and secondly resistors Rs each having a low resistance value. That is, since the start points of the lines of the membrane pattern in the column scan direction and the switch contacts s0, s1, s2, s3, and s4 of the switch matrix are configured to have the same resistance value, the wiring of the resistors can be completed by performing printing through a single patterning process.

A preferred embodiment of the present invention is described in detail below with reference to FIGS. 5 to 9.

Figure 5:
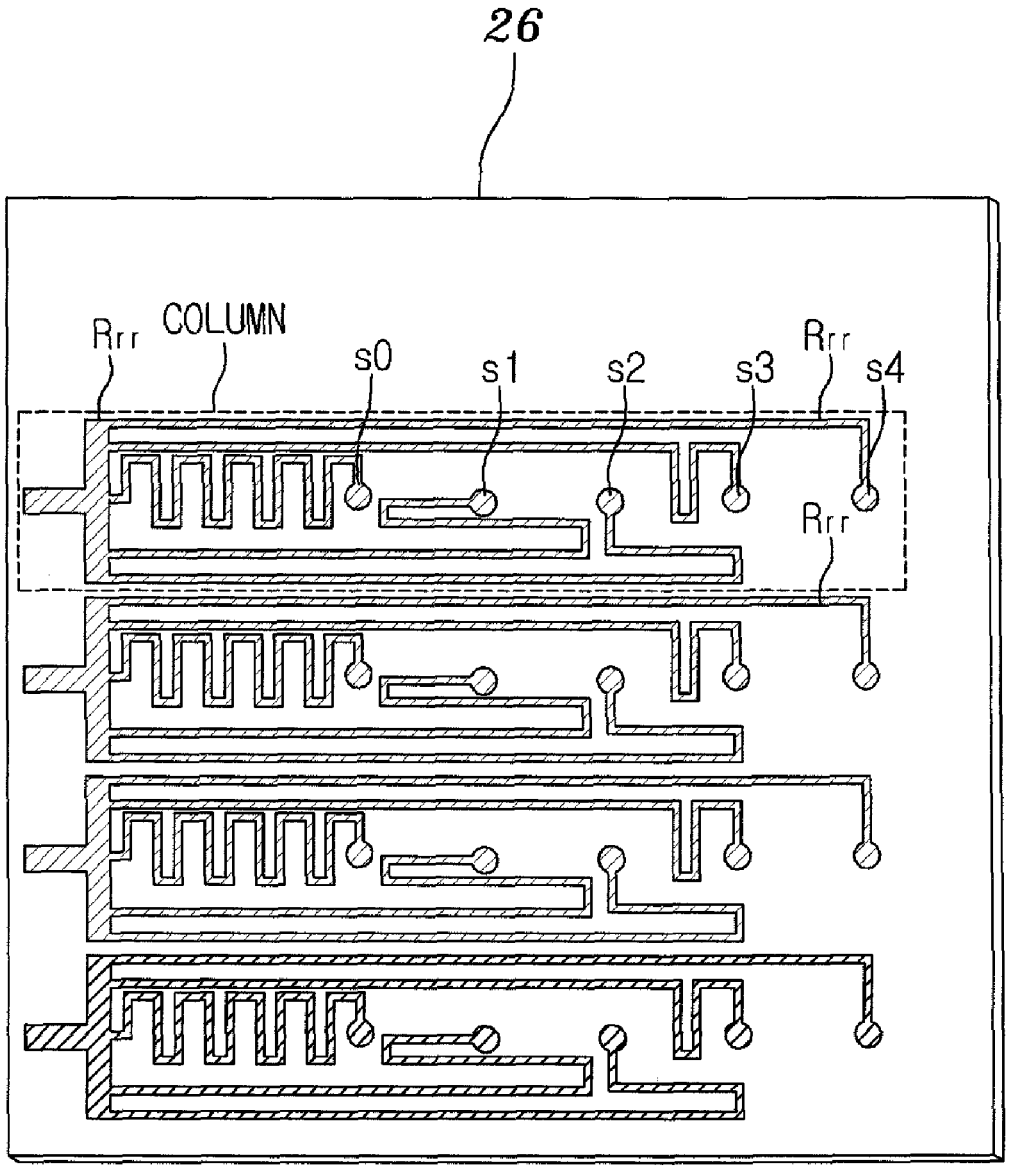
FIGS. 5 to 7 are diagrams illustrating a membrane switch sheet according to an embodiment of the present invention.
Figure 6:
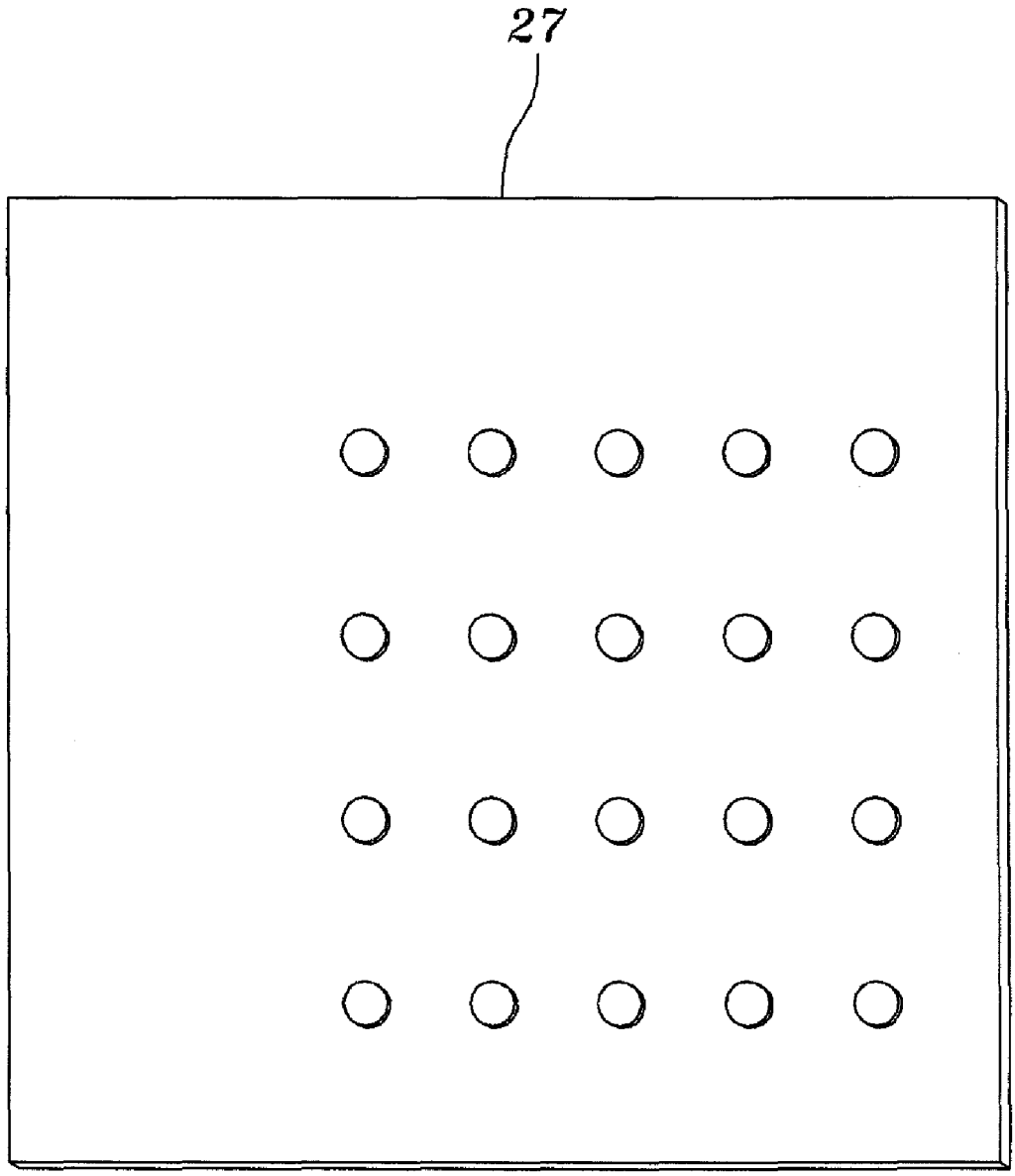
Figure 7:
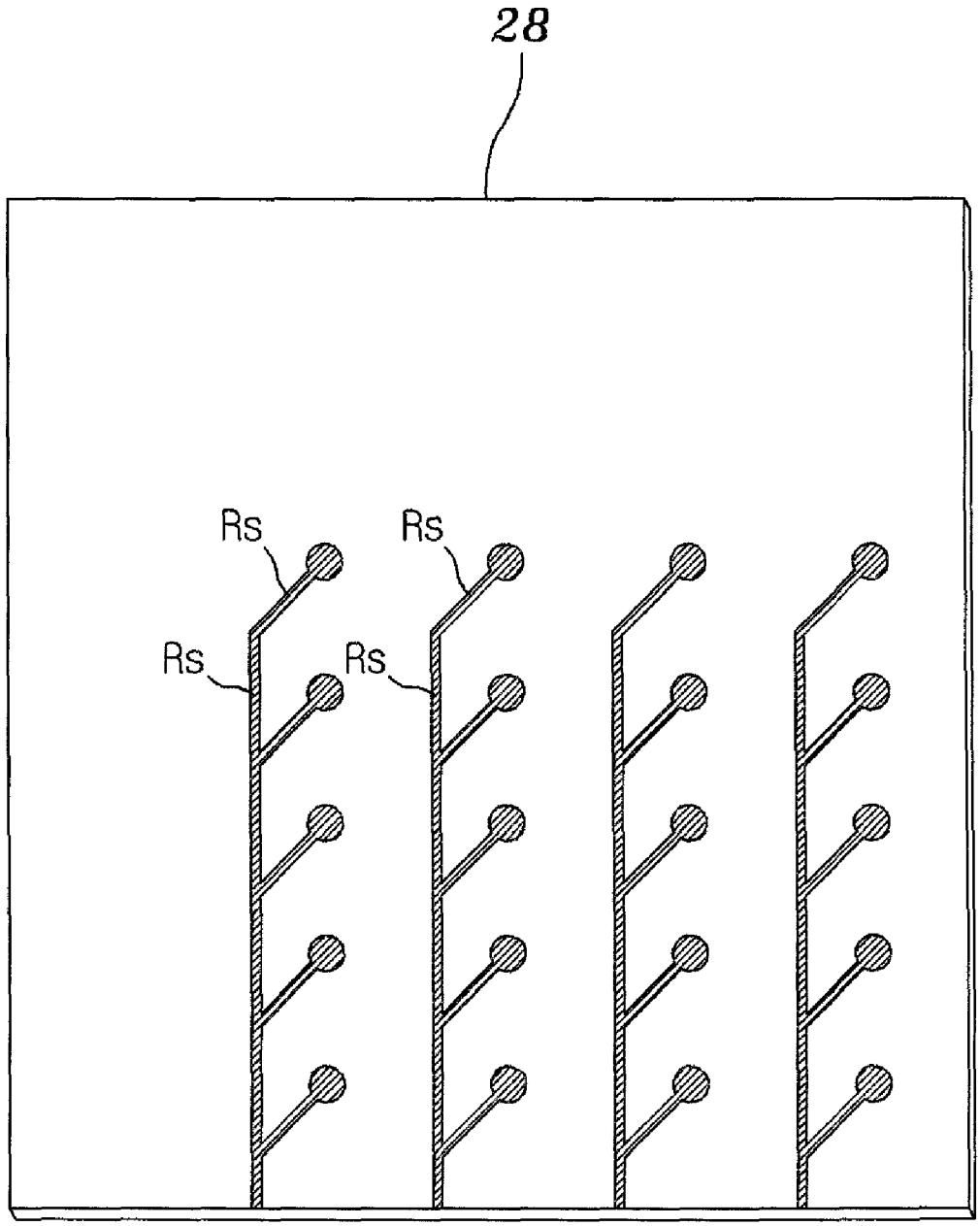

FIGS. 5 to 7 are diagrams illustrating a membrane switch sheet according to an embodiment of the present invention.

FIG. 5 shows the lower film of the membrane switch sheet, FIG. 6 shows the center film of the membrane switch sheet, and FIG. 7 shows the upper film of the membrane switch sheet. The three films are stacked one on top of one another, thus forming the membrane switch sheet. The membrane switch sheet constitutes the upper portion of a switch matrix in order to form a switch matrix-type key input apparatus.

The lower film 26 of the membrane switch sheet shown in FIG. 5 is formed by printing the lines of the switch matrix in the column scan direction on the top surface of a film using conductive ink. Here, the conductive ink having a single resistance value Rrr is patterned once. All conductive patterns are formed on the lower film 23 using only ink having low conductivity (a high resistance). The conductive ink used to form the conductive patterns may have an adjusted resistance value per square (Ohm per square, a sheet resistance, or a resistance unit) by adjusting the portion of an electric conductor (silver powder, carbon powder, or another conductive material).

Furthermore, the center film 27 of the membrane switch sheet of FIG. 6 includes a plurality of holes which will become switches. The center file 27 functions as an insulator with only portions for switches removed therefrom. Finally, the upper film 28 of the membrane switch sheet shown in FIG. 7 is formed by printing the lines of the switch matrix in the row scan direction using conductive ink having a resistance value Rs. That is, the center film 27 and upper film 28 of the membrane switch sheet of the present invention are formed using the same films as are used in the conventional membrane switch sheet.

In the membrane switch sheet composed of the three sheets of film, that is, the lower film 26, the center film 27 and the upper film 28, when weight is applied to the upper film (i.e., when a key signal is input through the switching operation of the switch matrix), a contact is made between the upper film 28 and the lower film 26, thus turning on a switch. When the weight is released (i.e., when the switching operation of the switch matrix is stopped), the switch is turned off by the restoring force of the film itself.

The membrane switch sheet of the present invention is formed through a single patterning process using only ink having low conductivity so that when the conductive ink is patterned on the lower film 26, the distances between the start point Ss of the lines in the column scan direction and the contacts of the switches have the same length and the resistors Rrr have the same resistance value.

Referring to FIG. 5, the lower film 26 is configured to include the switch contacts s0, s1, s2, s3 and s4 of the switch matrix and is wired through a single patterning process using the resistors Rrr each having a resistance value having low conductivity. The lower film 26 of FIG. 5 is patterned with four columns (as indicated by the dotted line), and the pattern in each column is wired to have the five switch contacts s0, s1, s2, s3 and s4.

The lower film 26 is described in more detail below with reference to FIGS. 8 and 9.

Figure 8:
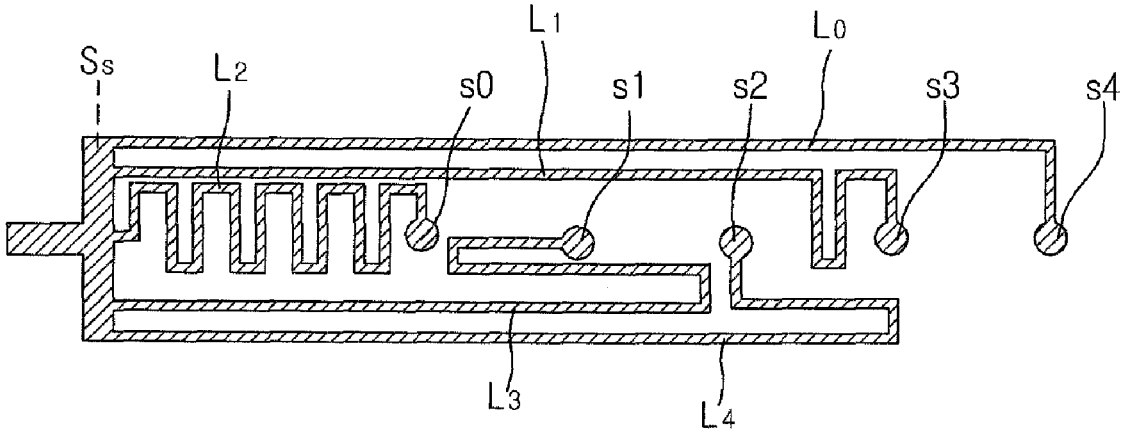
FIG. 8 is a wiring diagram illustrating the wring of the lines of the membrane switch sheet in a column scan direction according to the present invention.

FIG. 8 is a wiring diagram illustrating the wring of the lines of the membrane switch sheet in the column scan direction according to the present invention.

FIG. 8 shows wiring in one column of the lower film 26 shown in FIG. 5. The resistant patterns are configured such that the distances between the start point Ss on the left side and the switch contacts s0, s1, s2, s3 and s4 are the same lengths L0, L1, L2, L3 and L4. That is, the distance L2 between the start point Ss and the switch contact s0, the distance L3 between the start point Ss and the switch contact s1, the distance L4 between the start point Ss and the switch contact s2, the distance L1 between the start point Ss and the switch contact s3, and the distance L0 between the start point Ss and the switch contact s4 are all the same.

Accordingly, the resistance values between the start point Ss on the left side and the switch contacts s0, s1, s2, s3 and s4 are the same.

For example, when the patterns are formed so that the sheet resistance values between the conductive resistors are set to 10 Ω per 1 mm and the distances between the start points Ss of the switches on the left side and switch contacts are set to 700 mm, the resistance values between the start points Ss and the switch contacts are 7 kΩ. Accordingly, desired resistors Rrr may be patterned on the lower film 26 through a single printing process.

Figure 9:
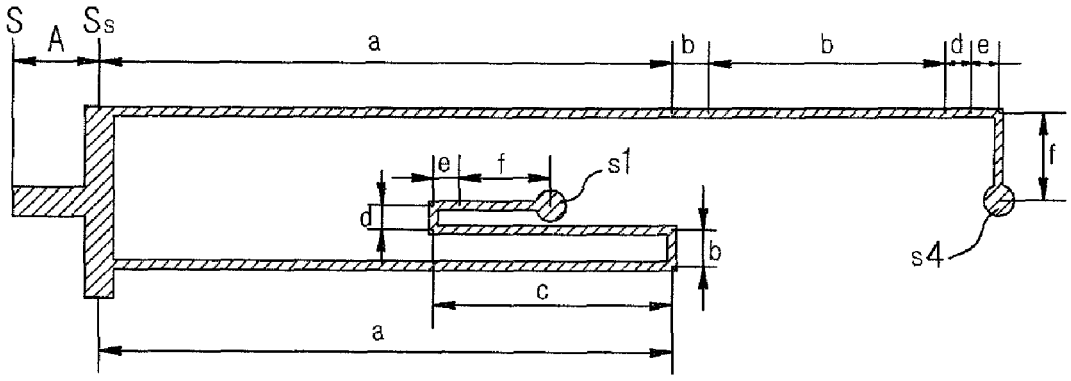
FIG. 9 is a wiring diagram illustrating resistance values on the membrane switch sheet according to the present invention.

FIG. 9 is a wiring diagram illustrating resistance values on the membrane switch sheet according to the present invention.

In order to pattern desired resistors through a single printing process as described above in conjunction with FIG. 8, the distances between the start point and the switch contacts have to be the same. For example, the switch contact s1 and the switch contact s4 are shown in FIG. 9 for convenience of illustration.

In FIG. 9, the distance between the start point Ss and the switch contact s1 corresponds to a+b+c+d+e+f, and the distance between the start point Ss and the switch contact s4 also corresponds to a+b+c+d+e+f. Accordingly, the distance between the start point Ss and the switch contact s1 and the distance between the start point Ss and the switch contact s4 are the same.

Here, if the distance between 'S' and the start point Ss is uniform based on locations at which the switch contacts are branched, or if relatively thick and short patterns are formed, the difference in the entire resistance component is very much smaller than a resistance value between the start point Ss and each of the switch contacts, so that it does not influence the embodiment of the present invention.

Furthermore, although an example in which the membrane sheet is implemented using the lower film has been described, the membrane sheet may be implemented using the upper film or both the upper film and the lower film.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A membrane switch sheet used in a switch matrix-type key input apparatus, including a plurality of switch contacts, so as to prevent occurrence of a ghost key phenomenon, the membrane switch sheet comprising:

at least one film wired through a single patterning process using only ink having low conductivity so as to have resistors having a same resistance value, with distances between start points of lines of a switch matrix in a column scan direction and the switch contacts being set to a same value.

2. The membrane switch sheet as set forth in claim 1, wherein an electric conductor of the ink having low conductivity is any one of silver powder, carbon powder and another conductive material.

3. The membrane switch sheet as set forth in claim 2, wherein the resistors having the same resistance value are patterned on the film through a single printing process, with a portion of the electric conductor and a resistance value per square being adjusted.

* * * * *